United States Patent [19]

Garrison

[11] 4,295,585

[45] Oct. 20, 1981

[54] MULTI-PIECE HANGER

[75] Inventor: Judd F. Garrison, Grand Rapids, Mich.

[73] Assignee: John Thomas Batts, Inc., Zeeland, Mich.

[21] Appl. No.: 30,287

[22] Filed: Apr. 16, 1979

[51] Int. Cl.[3] ..... A47J 51/14

[52] U.S. Cl. ..... 223/96

[58] Field of Search ..... 223/85, 90, 91, 96

[56] References Cited

U.S. PATENT DOCUMENTS

| | | | |
|---|---|---|---|
| 2,473,408 | 6/1949 | Alkin | 223/90 X |
| 2,524,537 | 10/1950 | Osmonson | 223/90 X |
| 2,573,622 | 10/1951 | Stoneburner | 223/90 X |
| 3,698,607 | 10/1972 | Batts | 223/96 |
| 3,767,092 | 10/1973 | Garrison et al. | 223/96 |
| 3,946,915 | 3/1976 | Crane | 223/96 |
| 3,973,705 | 8/1976 | Erthein | 223/96 |

*Primary Examiner*—Louis Rimrodt

*Attorney, Agent, or Firm*—Price, Heneveld, Huizenga & Cooper

[57] ABSTRACT

An article hanger is disclosed having a primary body portion and separate article gripping members. The gripping members are interfitted to the ends of the primary body and secured by an interlocking latch and keeper which can be assembled without the use of tools.

5 Claims, 11 Drawing Figures

10
11
11a
13
14
20
21
22
23
25
30
40
41
50
51
52
53
54
55
56
II
III
VII
VIII
IX
XI

MULTI-PIECE HANGER

BACKGROUND OF THE INVENTION

This invention relates to garment hangers, particularly those of the type designed to grip and suspend a garment. Hangers consisting of a primary rail or bar suspended from a hook and having a pair of clamping devices for engaging an article have become particularly popular as a display device for garments such as slacks and skirts. Heretofore, this type of hanger has been molded as a one piece device including the primary body portion and the garment engaging devices. In some cases the hook has also been molded as an integral part of the body portion. Such hangers are disclosed in U.S. Pat. No. 3,698,607, entitled GARMENT CLAMPING HANGER, granted Oct. 17, 1972 to John H. Batts and U.S. Pat. No. 3,767,092 entitled GARMENT CLAMPING HANGER WITH SLIDABLE LOCKING CLIP, granted Oct. 23, 1973 to Judd F. Garrison, et al. This invention constitutes an improvement on this type of garment hanger.

BRIEF DESCRIPTION OF THE INVENTION

The invention provides a hanger having a separate body and article gripping portions and a means of positively interlocking them. These portions are molded separately and so designed that they can be assembled subsequently. Thus, a single primary body portion may be used for several types of hangers, depending upon the type of article gripping member or terminal which is attached to it. The invention includes an attachment means which permits the garment anchoring device or terminal to be assembled to the primary hanger body quickly and without the necessity of using any tools.

DESCRIPTION OF THE PREFERRED EMBODIMENT

Figures 1, 2, 3, 10, 11:
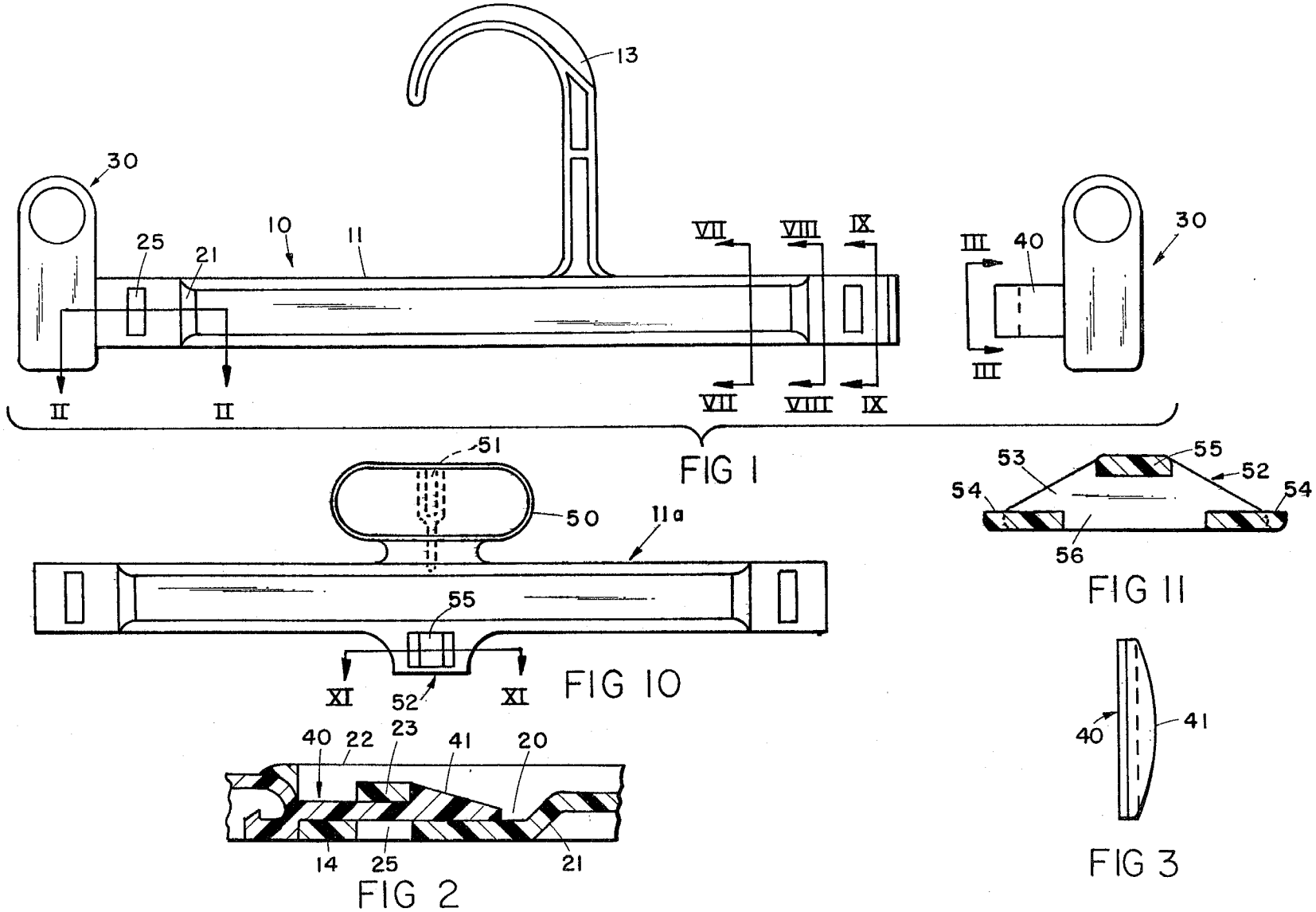
FIG. 1 is a side elevational view of a hanger incorporating this invention illustrating the garment gripping member secured to the hanger on the left side and the garment gripping device positioned for assembly to the hanger body on the right hand side.
FIG. 2 is an enlarged fragmentary sectional view taken along the plane II—II of FIG. 1.
FIG. 3 is an end view taken along the plane III—III of FIG. 1.
FIG. 10 is a front view of a modified hanger body.
FIG. 11 is an enlarged sectional view taken along the plane XI—XI of FIG. 10.
Figure 4:
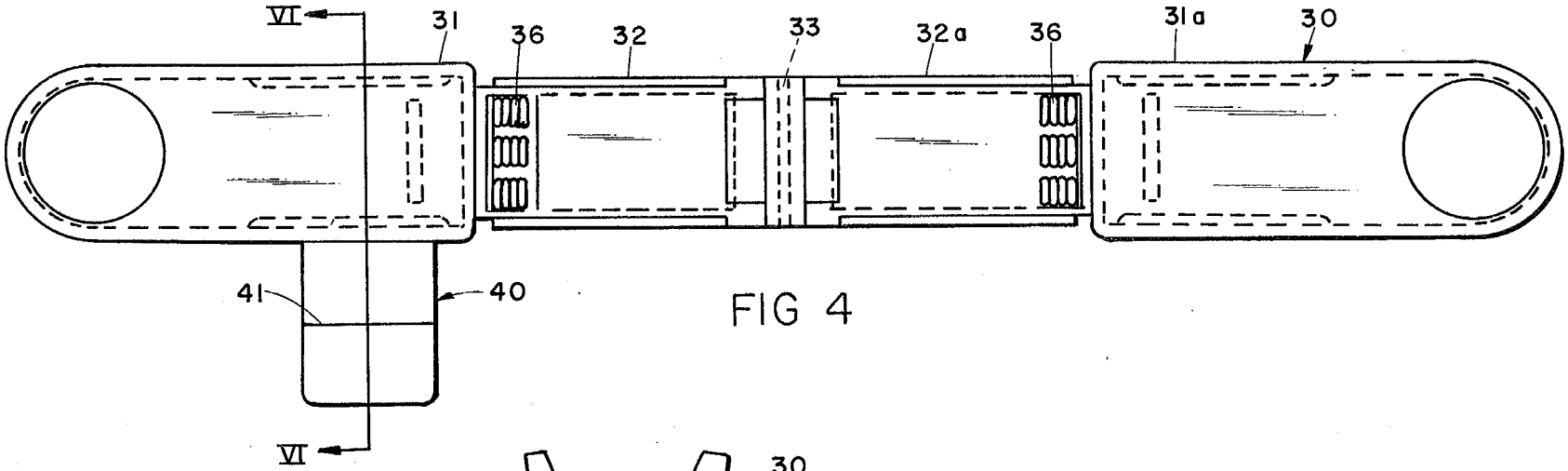
FIG. 4 is a view illustrating the terminal portion as it is molded and before being folded into operating position.
Figure 9:
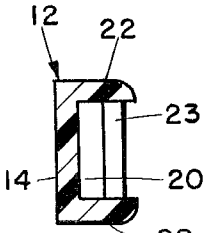
FIG. 9 is a sectional view taken along the plane IX—IX of FIG. 1.
Figure 8:
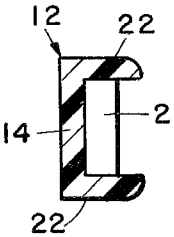
FIG. 8 is a sectional view taken along the plane VIII—VIII of FIG. 1.
Figure 7:
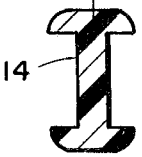
FIG. 7 is a sectional view taken along the plane VII—VII of FIG. 1.

Referring to FIG. 1, the numeral 10 refers to a hanger having a frame or primary body section 11. In the construction illustrated, the primary body section includes a bar or rail 12 which, as shown in FIG. 7, is of generally I-beam cross section with a central web 14 throughout most of its length. The choice of cross-sectional shape for the rail 12 is based upon considerations of strength, moldability, economy of material and over all appearance and various cross sectional shapes may be used within the concept of this invention. Integral with the body section 12 is a hook 13.

The rail 12 has a pair of identical ends. As best seen in FIGS. 2, 7, 8 and 9, each end has a slide track 20 formed by an offset of the central web 14 of the rail toward the back face of the hanger. This offset forms a step 21 in the web. The slide track 20 has a pair of sides 22 which are joined by a keeper bar 23 which spans between the sides 22 at a point spaced from both ends of the slide track. The keeper bar 23 is spaced rearwardly from the rear face of the web 14 of the rail. The front rail has an access opening 25 aligned forwardly of the keeper bar 23 to permit the bar to be formed in the mold without having an overhang which will result in a hang-up in the molding process.

Figure 5:
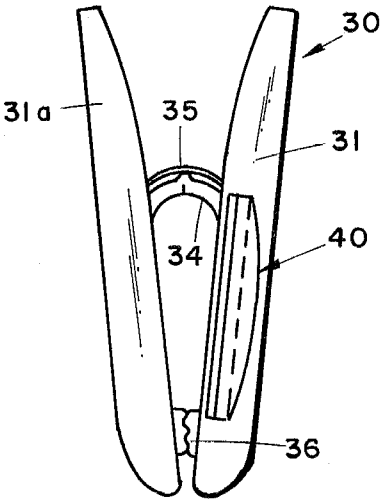
FIG. 5 is an end view of the terminal portion after it has been folded into operating position.
Figure 6:
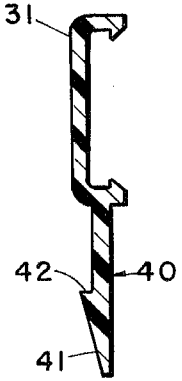
FIG. 6 is a sectional view taken along the plane VI—VI of FIG. 4.

It will be noted that the frame or primary body 11, including the hook and rail, has no means for engaging a garment. This is provided by the separate wings or terminal members 30 (FIGS. 1, 4, 5 and 6). The wings or terminals are fabricated as a separate and independent part and are assembled to the main body section after both have been manufactured. Each terminal member, as illustrated, consists of a pair of handles 31 and 31*a* which are integral with a pair of jaws or inner panels 32 and 32*a*. *The inner panels 32 and 32a* are joined by a hinge 33. These are all molded as a single integral piece in the form illustrated in FIG. 4. After molding, the jaws or inner panels are folded such that the two handles 31 and 31*a* are interfitted over the inner panels 32 and 32*a* which panels are folded about the hinge 33 to form the bridge 34 (FIG. 5). The assembled handles and jaws 31 and 31*a* are urged into closed or clamping position by a spring 35. The actual article contacting and gripping surfaces 36 are on the jaws or inner panels 32 and 32*a*. The construction of the terminal member, as described at this point, is more fully described in copending patent application Ser. No. 925,112, filed July 17, 1978, by John H. Batts which application has a common assignee.

Projecting from one of the handles and, in this case, from handle 31, is a tongue 40. The tongue 40 has a latch 41 projecting from one surface forming a shoulder 42. As best seen in FIG. 3, the latch 41 is preferably arched laterally to facilitate its insertion into the slide track 20 of the primary body 11. The thickness of the tongue 40 in the area between the shoulder 42 and the main body of the handle 31 is such that it will be snugly received in the channel formed between the web 14 and the bridge 23 at the end of the rail. At the inner end of the tongue, the side wall of the handle forms a stop. The width of the tongue is such that it fits closely within the slide track 20 between the sides 22. To secure one of the terminals or wings 30 to the main body of the hanger, all that has to be done is simply to press the tongue 40 inwardly along the track until the stop 41 has passed beyond the bar 23 permitting the shoulder 42 to engage behind the inner face of the bar. Thus, the latch 41 and keeper 23 form a positive lock against subsequent lengthwise disengagement of the assembled terminal 30 and main body 11. It will be noted that this assembly can be made without the use of any tools. Because of the close fit between the edges of the slide and the walls 22, the terminal member or wing is held against vertical rocking motion parallel to the plane of the web 14. As best seen in FIG. 2, the lead end of the tongue 40 is tapered to facilitate assembly in the slide track 20.

The main body portion 11 and the wing portions 30 are preferably molded of plastic. A suitable plastic for this purpose is a polypropylene. This plastic has sufficient rigidity to provide adequate support but has enough resiliency to permit the necessary flexing of the parts to permit assembly as shown in FIG. 2. It will be recognized that other plastics may be used provided they have the necessary characteristics of strength, rigidity and resilience. The combination of this limited resilience and the opening 25 in front of the keeper bar 23 facilitate insertion of the latch past the keeper bar 23. The arched shape of the latch portion 41 also contributes because it limits the amount of flexing of the bar required to permit assembly.

FIGS. 10 and 11 illustrate a modified construction for the main body section or frame. In this case, the frame 11*a* has an upstanding boss 50 which, in the particular construction illustrated, forms a front panel which may be used to display information. Extending down through this boss is a channel 51 which provides means for insertion of a hook, perferably a wire hook. This hook and its attachment can be so designed that it is either rigid or rotatable, depending upon the customer's requirements. Depending below the primary rail of the frame 11*a* is a boss 52. The boss 52 provides a channel 53 between its primary walls 54 and a post 55. The lower ends of the walls 53 and the post 54 are joined by a panel 56. The boss 52 provides means whereby a second hanger can be suspended from the first hanger simply by passing its hook through the channel 53. The fact that the walls of the boss are apertured forwardly of the post 55 permits the structure to be molded by fore and aft opening mold halves without the necessity for any provision to eliminate hang-up.

It will be recognized that the hanger of this invention has a number of advantages. Because the main body or frame portion can be molded separately from the terminal or wing portions, it is possible to mold a greater number of the frame bodies in a single mold because the cavity pattern becomes much more compact. In similar manner, the clamp structures or wings can be molded with an economy of mold size simply because they can be arranged in a much more compact pattern within the mold. The result is a more efficient and, thus, economical molding cycle.

The invention has further advantages in that a single frame or primary body design can be utilized for a number of hangers of different designs since the article gripping portion is molded as a separate part and, thus, a number of different types of such terminals or wings can be attached to a single frame design. Thus, a substantial degree of flexibility in adaptation to particular customer requirements is possible.

The cost of maintaining warehouse inventories adequate to meet customer requirements is also reduced since the molded primary frame structures can be stored in a much more compact fashion than is possible with the hanger having both the primary frame structure and the garment clamping devices a single integral part. At the same time, the terminal portions can be separately stored with marked economy in space requirements. This permits the various components to be warehoused and the actual hangers assembled only when ordered by a customer and the hangers can be customized to customer needs by selection of the appropriate frame and terminal portions.

It will be seen that the invention has broad application to hangers and is not specifically limited to any one specific type of design for the main portion nor is it limited to any particular type of design for the terminal portion. A wide range of designs may be used for the main frame and a wide range of designs may be used for the terminals. In fact, the type of article grip illustrated in either U.S. Pat. No. 3,698,607 or No. 3,767,092 (identified above) may be substituted for the particular article grip illustrated and described above. These are only some of the more obvious modifications which may be made of this invention. These and other modifications which incorporate the principles of the invention are to be considered as included in the hereinafter pended claims unless these claims by their language expressly state otherwise.

The embodiments of the invention in which an exclusive property or privilege is claimed are defined as follows:

1. An article hanger having a frame and an article engaging member; said frame having means by which it can be suspended, said article hanger characterized in that said article engaging number and said frame are separate components and two-part means are provided for locking said article engaging member and frame together, said means including a track opening through one end of said frame and said article engaging member having a tongue adapted to be slidably and telescopically received in said track, said track and tongue being shaped to hold said article engaging member against rotation in any direction with respect to said frame.

2. An article hanger as described in claim 1 further characterized in that one of said parts is a latch and the other a keeper.

3. An article hanger having a body member and a pair of article engaging members; said body member having a pair of oppositely directed ends and means by which said body member can be suspended, said article hanger characterized in that said article engaging members and said body member are separate components; means for rigidly securing one of said article engaging members to each of said ends of said body member; said means including a two-part telescoping interlock element having one part on said body member and the other part on said article engaging member; one of said parts being a slide track and the other a tongue slidably received in said slide track; said slide track and tongue being shaped to prevent rotation of one with respect to the other in any direction; each of the article engaging members having a pair of jaws forming a clamp opening at a right angle to the axis of said body member and means for biasing the jaws of said clamp closed.

4. An article hanger as described in claim 3 further characterized in that a keeper bar spans each of said slide tracks, each of said tongues having a latch shoulder seating against the side of said bar facing away from the open end of said track when said article engaging members are assembled to said body portion.

5. An article hanger as described in claim 4 further characterized in that said body portion is molded of a plastic which will permit said keeper bar to flex sufficiently to permit said latch shoulder to be moved past it in said slide track; said latch shoulder being arched cross-wise of said slide track to facilitate flexing of said keeper bar.

* * * * *